United States Patent [19]

de Witte

[11] Patent Number: 4,485,334

[45] Date of Patent: Nov. 27, 1984

[54] SPARK GAP APPARATUS COMPRISING A PLURALITY OF PAIRS OF ELECTRODES IN PARALLEL

[75] Inventor: Olivier de Witte, Gif sur Yvette, France

[73] Assignee: Compagnie Generale d'Electricite, Paris, France

[21] Appl. No.: 396,943

[22] Filed: Jul. 9, 1982

[30] Foreign Application Priority Data

Jul. 28, 1981 [FR] France ..... 81 14619

[51] Int. Cl.[3] ..... H05B 37/00

[52] U.S. Cl. ..... 315/167; 315/336

[58] Field of Search ..... 315/111.01, 167, 168, 315/335, 336, 346; 313/231, 307, 308, 595, 596, 601, 603, 589; 250/324

[56] References Cited

U.S. PATENT DOCUMENTS 4,114,114 9/1978 Pressley et al. ..... 315/336 X 4,227,234 10/1980 Seanor ..... 361/229

FOREIGN PATENT DOCUMENTS 2012492A 7/1979 United Kingdom .

641569 1/1979 U.S.S.R. ..... 315/335

*Primary Examiner*—David K. Moore

*Attorney, Agent, or Firm*—Sughrue, Mion, Zinn, Macpeak & Seas

[57] ABSTRACT

A plurality of electrodes (7, 10) are arranged along two rows facing each other in pairs, leaving a spark gap in between the rows of electrodes. Each row comprises a plurality of electrodes connected in parallel. The electrodes are in a gas. The problem is to trigger simultaneous arcs between each pair of electrodes. This is achieved by extending an insulated conductor (15) parallel to the rows and then in applying pulses to the insulated conductor to obtain a corona discharge around it. The resulting ions suddenly reduce the striking potential across the spark gap. A potential difference is applied across the gap by a generator (12). The potential is below the nonionized striking potential and above the ionized striking potential. The sudden drop in striking potential ensures that all pairs of electrodes strike substantially simultaneously. The apparatus can be used to excite a high repetition rate gas laser generators.

4 Claims, 2 Drawing Figures

SPARK GAP APPARATUS COMPRISING A PLURALITY OF PAIRS OF ELECTRODES IN PARALLEL

The present invention relates to spark gap apparatus comprising a plurality of pairs of electrodes connected in parallel.

BACKGROUND OF THE INVENTION

A spark gap exists between each pair of electrodes, and the electrode pairs are separated by a dielectric, such as a gas. As an ever increasing potential is applied to the electrodes across the gap, there comes a potential at which a spark will leap across the gap between the electrodes. This potential is known as the striking potential. Spark gaps are used, in particular, as a means for creating an electrical discharge by short circuiting a capacitor in order to excite some kinds of gas laser.

When a particularly large amount of energy is released in the spark, and it is desired to operate the laser at a high repetition rate, a multiple or rail spark gap is used comprising a plurality of pairs of electrodes connected in parallel. This arrangement has the advantage of reducing the discharge impedance and of increasing the sevice life of the electrodes used.

However, such multiple spark gaps suffer from a drawback: although the gap between each pair of electrodes can be individually adjusted, it remains difficult to obtain a simultaneous discharge between all the pairs of electrodes.

Preferred embodiments of the present invention mitigate this drawback.

SUMMARY OF THE INVENTION

The present invention provides spark gap apparatus comprising:

a first row of n electrodes connected in parallel, where n is an integer not less than two;

a second row of n electrodes connected in parallel and disposed opposite to respective ones of the n electrodes of the first row;

a gas disposed between the electrodes of the first and second rows;

a first source of electrical high tension having first and second terminals connected respectively to the electrodes of the first row and to the electrodes of the second row, the tension delivered by said first source being below the striking potential between the pairs of electrodes;

an insulated conductor disposed along the two rows of electrodes; and a second source of electrical high tension, said second source being a pulse source for generating high tension pulses and having a first terminal connected to said insulated conductor and a second terminal connected to one of the rows of electrodes, whereby, in operation, a luminous corona discharge is formed around the insulation of the conductor, thereby ionizing at least some of said gas between the electrodes and thus ensuring simultaneous striking of n electrical arcs between the respective pairs of electrodes in said first and second rows.

BRIEF DESCRIPTION OF THE DRAWINGS

An embodiment of the invention is described by way of example with reference to the accompanying drawing, in which.

MORE DETAILED DESCRIPTION

Figure 1:
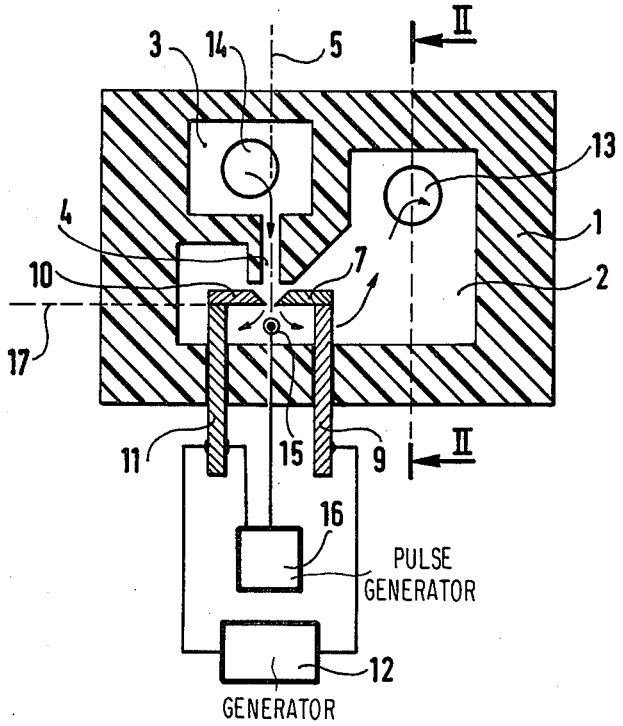
FIG. 1 is a diagrammatic cross section through a spark gap in accordance with the invention.

In the figures, a rectangular insulating housing 1 comprises a working chamber 2 having an opening 13, and a supply chamber 3 having an opening 14. The working and supply chambers 2 and 3 are in communication with each other by means of a longitudinally extending slot 4 of rectangular section and lying in a plane 5.

Ten pairs of electrodes are arranged in the working chamber 2 at the outlet from the slot 4. The electrodes may be made of brass, copper or stainless steel. They are arranged in two rows on either side of the plane 5 and parallel thereto. Each electrode is disposed opposite to a corresponding electrode in the other row. One pair of opposite electrodes 7 and 10 is visible in FIG. 1.

Figure 2:
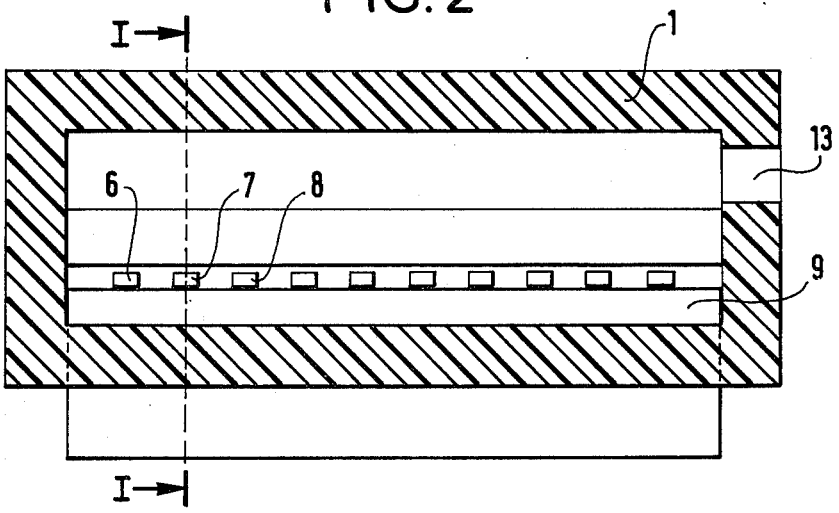
FIG. 2 is a longitudinal section along a plane II-II of FIG. 1.

The successive pairs of electrodes are regularly spaced along the length of the working chamber 2, with the electrodes of one row, eg. the electrodes 6, 7 and 8 as shown in FIG. 2, being connected at one end to a metal plate 9 which extends parallel to the plane 5, and the electrodes of the other row being similarly connected at the opposite end to a metal plate 11, which also extends parallel to the plane 5. The plates 9 and 11 pass through the wall of the housing 1 and are connected to respective terminals of a source of electrical high tension 12.

An insulated conductor 15 runs along the working chamber 2 parallel to the gap between the two rows of electrodes. The conductor is preferably a nickel wire surrounded by a tube of glass, with the inside volume of the tube further containing a conductive solution, for example. The wire is connected to one terminal of a source of electrical pulses 16, with the other terminal of the pulse source 16 being connected to the plate 11.

The spark gap described above and illustrated in FIGS. 1 and 2 operates as follows:

A flow of gas is injected into the chamber 3 via the opening 14, eg. coming from a bottle of compressed air provided with a pressure reducer (not shown). The air passes through the slot 4 and on through the gap between the pairs of electrodes before leaving the chamber 2 via the opening 13. The distance between the various pairs of electrodes is adjusted so that the striking potential between facing electrodes is greater than the potential difference provided by the source 12. The potential difference may be $\frac{2}{3}$ of the striking potential, for example.

In the arrangement shown in the drawing, the two rows of electrodes are situated in a plane 17 perpendicular to the plane 5, and the conductor wire 15 is disposed substantially in the plane 5, downstream from the plane 17 and generally in parallel therewith.

The amplitude of the high tension pulses delivered by the source 16 is sufficient for each pulse to cause a luminous corona discharge around the insulator of the insulated conductor 15. This discharge creates ions in the gas flowing between the electrodes, thereby triggering ten simultaneous electric arcs between the two rows of electrodes. The gas flow helps to extinguish the arcs between two successive arcs.

When the spark gap apparatus in accordance with the invention is used to excite a gas laser generator, the plates 9 and 11 may comprise the plates of a capacitor (eg. a capacitor using de-ionised water as a dielectric).

The source 12 is then a high tension pulse generator which periodically charges the capacitor. Using synchronising means, the pulses from the generator 16 are arranged to arrive at some suitable time interval after the pulses from the generator 12, in such a manner that the ionisation produced by the conductor 15 occurs at the moment of maximum potential difference between the electrodes.

Naturally the power of the pulse generator 16 is negligeable compared with the power of the pulse generator 12.

By way of example, the above described apparatus can be used to obtain simultaneous arcs between the electrode pairs at a repetition rate of 1000 Hz, with the electric discharge rise time being about 5 ns. At such a rate, and when switching a current of about 100,000 amps, the electrodes have a life time of about $10^9$ successive arcs.

I claim:

1. Spark gap apparatus comprising:

a first row of n electrodes connected in parallel, where n is an integer not less than two;

a second row of n electrodes connected in parallel and disposed opposite to respective ones of said n electrodes of the first row and forming a gap therebetween;

a gas disposed between the electrodes of the first and second rows;

a first source of electrical high tension having first and second terminals connected respectively to the electrodes of the first row and to the electrodes of the second row, the tension delivered by said first source being below the striking potential between the pairs of electrodes;

an insulated conductor disposed along the two rows of electrodes and in parallel with said gap; and a second source of electrical high tension, said second source being a pulse source generating high tension pulses and having a first terminal connected to said insulated conductor and a second terminal connected to one of the rows of electrodes, and wherein said second source of electrical high tension generates sufficiently high tension pulses such that, in operation, a luminous discharge is formed around the insulation of the conductor, thereby ionizing at least some of said gas within said gap between the electrodes and thus ensuring simultaneous striking of n electrical arcs between the respective pairs of electrodes in said first and second rows, and said apparatus further comprises means for causing the gas to flow through said gap between said rows of electrodes.

2. Spark gap apparatus according to claim 1, wherein said two rows of electrodes are disposed in a plane and wherein said flow of gas between said rows of electrodes takes place in a direction perpendicular to said plane, with said insulated conductor being disposed downstream from said plane.

3. A spark gap apparatus as claimed in claim 1, wherein said insulated conductor comprises a wire surrounded by a tube of glass and said tube containing a conductive solution.

4. A spark gap apparatus as claimed in claim 2, wherein said insulated conductor comprises a wire surrounded by a tube of glass and said tube containing a conductive solution.

* * * * *